US011722813B2

(12) United States Patent
Keikhosravy et al.

(10) Patent No.: US 11,722,813 B2
(45) Date of Patent: Aug. 8, 2023

(54) SITUATIONAL AWARENESS, COMMUNICATION, AND SAFETY FOR HEARING PROTECTION DEVICES

(71) Applicant: PICOTERA ELECTRONICS INC., Richmond (CA)

(72) Inventors: Kamyar Keikhosravy, Vancouver (CA); Ali Reza Mohazab, Vancouver (CA); Justin Mede, Burnaby (CA)

(73) Assignee: Picotera Electronics Inc., Richmond (CA)

( * ) Notice: Subject to any disclaimer, the term of this patent is extended or adjusted under 35 U.S.C. 154(b) by 0 days.

(21) Appl. No.: 17/177,929

(22) Filed: Feb. 17, 2021

(65) Prior Publication Data

US 2022/0264219 A1 Aug. 18, 2022

(51) Int. Cl.
*H04R 1/10* (2006.01)

(52) U.S. Cl.
CPC ..... *H04R 1/1083* (2013.01); *H04R 1/1008* (2013.01)

(58) Field of Classification Search
CPC ..... H04R 1/1083; H04R 1/1008
USPC ..... 381/74
See application file for complete search history.

(56) References Cited

U.S. PATENT DOCUMENTS 8,649,525 B2 2/2014 Birgersson
9,628,914 B2 4/2017 Gauger, Jr.
9,901,252 B2 2/2018 Tran
10,129,633 B1 * 11/2018 Patil ..... G08B 13/19663
10,687,145 B1 * 6/2020 Campbell ..... H04H 60/58
2010/0195842 A1 * 8/2010 Sibbald ..... G10K 11/17861 381/71.6
2014/0126736 A1 5/2014 Gauger, Jr. et al.
2014/0247948 A1 * 9/2014 Goldstein ..... H04R 1/1041 381/58
2015/0055784 A1 2/2015 Brayton
2015/0117660 A1 4/2015 Fletcher et al.
(Continued)

FOREIGN PATENT DOCUMENTS

CN 105812974 A * 7/2016 ..... B60W 50/14
EP 2833646 A1 * 2/2015 ..... H04R 1/1091

*Primary Examiner* — Vivian C Chin
*Assistant Examiner* — Friedrich Fahnert
(74) *Attorney, Agent, or Firm* — Oyen Wiggs Green & Mutala LLP

(57) ABSTRACT

An apparatus for hearing protection comprises a pair of earpads, a band, microphones, speakers, vibration generators, and a processing unit. Each of the earpads is placed over an ear of the user. The band extends between the pair of earpads. The microphones convert acoustic signals into electrical signals. The speakers are located on each of the pair of earpads and direct sound towards the ear. The vibration generators are located on at least one of the pair of earpads and generate vibratory feedback to the user. The processing unit is connected to the microphones, the speakers, and the vibration generators, and compares first parameters of the electrical signals from the microphones with second parameters of predetermined warning sounds to determine whether the electrical signals comprise one or more of the predetermined warning sounds. If the processing unit determines that the electrical signals comprise one or more of the predetermined warning sounds, the processing unit transmits a warning to the speakers and the vibration generators.

6 Claims, 9 Drawing Sheets

(56) References Cited

U.S. PATENT DOCUMENTS

| | | | | |
|---|---|---|---|---|
| 2015/0170493 | A1 | 6/2015 | Beggs et al. | |
| 2015/0355880 | A1 | 12/2015 | Kraft et al. | |
| 2015/0366518 | A1* | 12/2015 | Sampson | A61B 5/0205 600/509 |
| 2016/0193084 | A1 | 7/2016 | Jenkins | |
| 2017/0352242 | A1 | 12/2017 | Glynn et al. | |
| 2017/0374436 | A1 | 12/2017 | Awiszus et al. | |
| 2019/0387299 | A1* | 12/2019 | Evans | G06F 3/04815 |
| 2020/0178011 | A1* | 6/2020 | Lin | H04R 29/00 |
| 2021/0019108 | A1* | 1/2021 | Smith | H04S 7/304 |

* cited by examiner

SITUATIONAL AWARENESS, COMMUNICATION, AND SAFETY FOR HEARING PROTECTION DEVICES

FIELD OF THE INVENTION

The present invention relates to hearing protection and communications devices and systems. In particular, the invention relates to methods and apparatuses for improving the situational and directional awareness and communicational ability of users wearing hearing protection devices.

BACKGROUND OF THE INVENTION

Noise at industrial sites is a significant cause of work-related accidents and injuries. Conventional hearing protection devices (HPD), such as headphones, earmuffs, or earplugs, provide some degree of acoustic protection. This may be through passive noise reduction (which involves using insulating materials to block sound from the ears) or active noise reduction (which involves electronic circuitry to generate noise in negative phase to cancel out unwanted external noise).

One of the problems with conventional HPDs is that the user wearing such devices will often have lower situational and directional awareness and have a harder time communicating with other users. This is because the noise reduction offered by HPDs will also have the effect of attenuating both unwanted and wanted sounds. Therefore, users may miss or not hear sounds that are important (e.g. warning sound and alarms, spoken words, etc.). Furthermore, even if the user hears a warning sound or alarm, the user may not be aware that the warning sound or alarm is for them and/or that there is any danger and therefore ignore the warning.

Acoustic warning detectors disclosed in the prior art typically comprise complex building blocks with high power and processing requirements. The prevalence of portable music players accompanied with high-quality noise cancellation headphones may allow for simpler warning detection systems. Such a system has to detect some or all types of acoustic warning signals, such as police and ambulance sirens, car and truck's horns, loud noises, designated words, etc. Upon detection of any of such warning signals, the system should generate a configurable notification for the user. The system should also be energy-efficient, portable, configurable, and capable of communicating with popular music players in the market.

It is therefore desirable to provide a HPD that also allows for improved situational and directional awareness by utilizing a combination of warning sound detection, noise cancellation, built-in communication and vocal sound amplification. It is also desirable that such a HPD allow for communications among users and remote monitoring.

SUMMARY OF THE INVENTION

The present invention comprises a hearing protection device that is configured to detect and identify predetermined warning sounds and signals. The predetermined warning sounds can be static (e.g. configured at factory) or alternatively they may be updated by the users in-situ. Upon detection of such warning sounds or signals, a notification may be provided to the user.

The hearing protection device also provides adjustable acoustic protection, which is able to automatically (or manually by the user) adjust the level of acoustic protection based on external noise levels measured in real-time in a hearing protection device or another device connected to the hearing protection device. Based on a real-time calculated surrounding noise level, the hearing protection device is configured to increase or decrease the acoustic protection by adjusting the volume of environmental sounds that is provided to the user's ears.

In another aspect of the invention, the hearing protection device is configured to provide for wireless communications with other hearing protection devices. In addition, the hearing protection device may be paired with a wristband or other wearable devices, such as smart watches or smart goggles (e.g. with heads-up displays). Alternatively, it may be paired to communicate with a central monitoring system.

In yet another aspect of the invention, the hearing protection device may be connected to a mobile device. Communications between different users may be achieved through communication between the respective mobile devices.

In a further aspect of the invention, the hearing protection device may be configured to detect tap patterns, which may be used to issue various commands to the hearing protection device.

In one aspect of the invention, an apparatus for hearing protection for a user comprises a pair of earpads, a band, one or more microphones, one or more speakers, one or more vibration generators, and a processing unit. Each of the earpads is adapted to be placed over an ear of the user and comprises an exterior surface. The band extends between the pair of earpads. The microphones are adapted to convert acoustic signals into electrical signals, with the microphones located on the exterior surface. The speakers are located on each of the pair of earpads and are adapted to direct sound towards the ear. The vibration generators are located on at least one of the pair of earpads and are adapted to generate vibratory feedback to the user. The processing unit is connected to the microphones, the speakers, and the vibration generators, and the processing unit is adapted to compare first parameters of the electrical signals from the microphones with second parameters of predetermined warning sounds to determine whether the electrical signals comprise one or more of the predetermined warning sounds. If the processing unit determines that the electrical signals comprise one or more of the predetermined warning sounds, the processing unit is adapted to transmit a warning to one or more of the speakers and the vibration generators.

In another aspect of the invention, the speakers, upon receipt of the warning, output an auditory signal to the user.

In still another aspect of the invention, the vibration generators, upon receipt of the warning, generate vibratory feedback.

In still a further aspect of the invention, the processing unit is further adapted to use machine language techniques to transmit the warning to one or more of the speakers and the vibration generators when the first parameters sufficiently correspond to the second parameters.

In yet another aspect of the invention, the apparatus further comprises one or more motion sensors located on one or more of the pair of earpads or smart earplug companion device, with the motion sensors transmitting information to the processing unit regarding detected movement of the earpad, and with the processing unit further adapted to transmit the warning if the detected movement shows no change for a predetermined amount of time. This prevents unnecessary notifications which may cause user start ignoring similar alarms.

In still yet another aspect of the invention, the apparatus further comprises one or more proximity sensors located on one or more of the pair of earpads, with the proximity sensors transmitting information to the processing unit regarding changes in distance between the proximity sensors and an object, and with the processing unit further adapted to transmit the warning if the distance between the proximity sensors and the object is decreasing. Proximity sensors can be located on the hard hat, earplugs, earmuff or the companion device. Signals received from proximity sensor can tell if the moving object (detected by backup alert detection for example) is approaching the user or getting farther from user. Is it coming from blind spots of the user or in front of the user in which user may have visual of the object? Based on the location and direction of the movement of the object we decide whether or not we notify the user of hazard of being hit by a vehicle.

In still a further aspect of the invention, the apparatus further comprises a transceiver for transmitting the warning to an external device.

In another aspect of the invention, an apparatus for hearing protection for a user comprises a pair of earbuds, a control unit, one or more microphones, one or more speakers, one or more vibration generators, a processing unit, and a notification module. Each of the earbuds is adapted to be placed over an ear of the user. The control unit is connected to each of the pair of earbuds. The microphones are adapted to convert acoustic signals into electrical signals, with the microphones located one or both of the earbuds and the control unit. The speakers are located on each of the pair of earbuds, with the speakers adapted to direct sound towards the ear. The vibration generators are located on one or both of the earbuds and the control unit, with the vibration generators adapted to generate vibratory feedback to the user. The processing unit is in the control unit, with the processing unit adapted to compare first parameters of the electrical signals from the microphones with second parameters of predetermined warning sounds to determine whether the electrical signals comprise one or more of the predetermined warning sounds, and if the processing unit determines that the electrical signals comprise one or more of the predetermined warning sounds, the processing unit is adapted to generate a warning. The notification module is connected to the speakers and the vibration generators and adapted to receive the warning from the processing unit and to transmit the warning to the speakers and the vibration generators.

In still another aspect of the invention, the control unit further comprises a display configured to display messages to the user.

In still yet another aspect of the invention, the apparatus further comprises an external device separate from the earbuds and the control unit. The external device comprises an external processor and one or more external sensors. The external processor is in communication with the processing unit and the notification module, and the external sensors are in communication with the external processor. The processing unit is adapted to transmit the warning to the external processor, with the external processor, based on information from the external sensors, able to transmit a message to the notification module to prevent transmission of the warning to the speakers and the vibration generators.

In still a further aspect of the invention, the external sensors comprise location sensors to detect a location of the external device.

In another aspect of the invention, a safety apparatus for a user comprises a hearing protection device and a communications device. The hearing protection device is worn over the ears of the user. The communications device is carried by the user, with the communications device in communications with the hearing protection device. The communications device comprises one or more sensors, one or more microphones, and a processing unit. The sensors comprise one or more of the following: accelerometers, gyroscopes, motion sensors, and heart rate sensors. The microphones convert acoustic signals into electrical signals. The processing unit is adapted to receive information from the one or more sensors and to receive the electrical signals, with the processing unit further adapted to generate a warning to the hearing protection device based, at least in part, on the information from the sensors and from the electrical signals.

In still another aspect of the invention, the communications device further comprises a transceiver for communicating with another one of the communications devices.

In still yet another aspect of the invention, the communications device is adapted to transmit the warning to the another one of the communications devices through the transceiver.

In a further aspect of the invention, the processing unit is further adapted to compare first parameters of the electrical signals from the microphones with second parameters of predetermined warning sounds to determine whether the electrical signals comprise one or more of the predetermined warning sounds, and if the processing unit determines that the electrical signals comprise one or more of the predetermined warning sounds, the processing unit is adapted to generate the warning.

In a still further aspect of the invention, the communications device is a wristband.

In a still yet further aspect of the invention, the communications device comprises a user interface, with the user interface adapted to accept haptic input from the user.

The hearing protection device may also contain sensors, including but not limited to accelerometers, gyroscopes, or compasses (magnetometers) and use the inputs from these devices to further assess the health and safety situation of the user and take the appropriate action as needed. The readings from the sensor can also act as input methods by the user for more complex interactions with the device.

In another embodiment of the invention, a safety apparatus for a user comprises a mobile device and a tag. The mobile device is configured to play audio to the user. The tag comprises a clip configured to attach to the user, one or more microphones, a tag processor, and a tag transceiver. The microphones are configured to convert acoustic signals into electrical signals. The tag processor is configured to process the electrical signals and to detect if the electrical signals correspond to one or more predetermined warning sounds. The tag transceiver is configured to communicate wirelessly with the mobile device. The tag transceiver is further configured to transmit an alert to the mobile device when the tag processor detects that the electrical signals correspond to one or more of the predetermined warning sounds. The mobile device is configured to stop playing of the audio upon receipt of the alert from the tag transceiver.

In still another embodiment of the invention, the tag further comprises one or more tag vibrators. The one or more tag vibrators are configured to cause vibration when the tag processor detects that the electrical signals correspond to one or more of the predetermined warning sounds.

In yet another embodiment of the invention, the tag further comprises a tag display configured to display information to the user.

In still yet another embodiment of the invention, the tag transceiver is further configured to receive information from the mobile device regarding the audio played by the mobile device. The tag display is further configured to display the information.

The foregoing was intended as a broad summary only and of only some of the aspects of the invention. Other aspects of the invention will be more fully appreciated by reference to the detailed description and the drawings.

BRIEF DESCRIPTION OF THE DRAWNGS

The invention will be described by reference to the detailed description and to the drawings thereof in which.

DETAILED DESCRIPTION OF THE INVENTION

Figure 1:
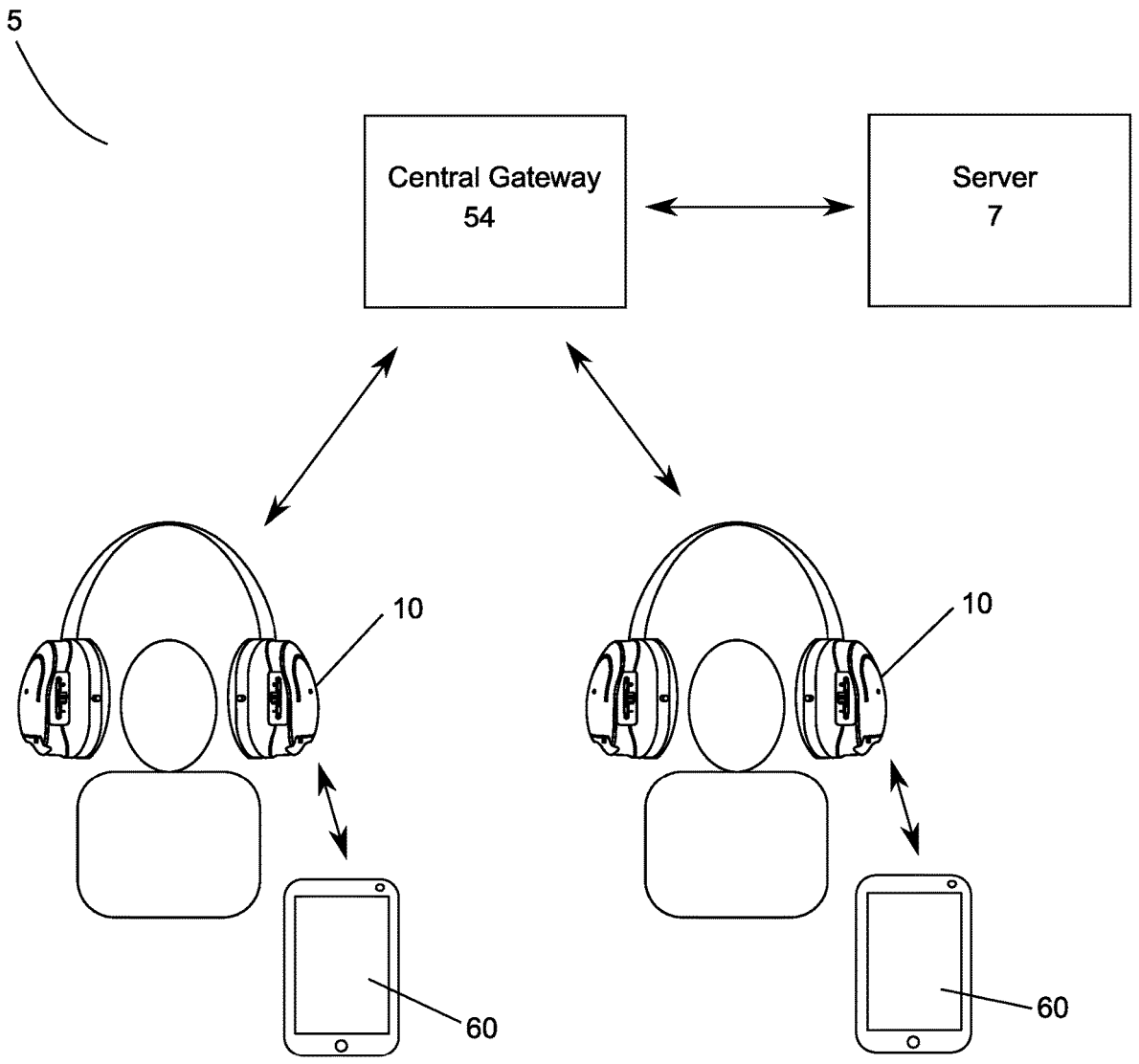
FIG. 1 shows the system in accordance with the invention.

In the following description, various aspects of the illustrative implementations will be described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials and configurations are set forth in order to provide a thorough understanding of the illustrative implementations. However, it will be apparent to one skilled in the art that embodiments of the present disclosure may be practiced without the specific details. In other instances, well-known features are omitted or simplified in order not to obscure the illustrative implementations.

In the following detailed description, reference is made to the accompanying drawings that form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

In some cases, various operations will be described as multiple discrete operations in turn, in a manner that is most helpful in understanding the present disclosure; however, the order of description should not be construed to imply that these operations are necessarily order dependent. In particular, these operations need not be performed in the order of presentation.

For the purposes of the present disclosure, the phrase "A and/or B" means (A), (B), (A) or (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. Furthermore, it is to be understood that the various embodiments shown in the Figures ("FIGs.") are illustrative representations and are not necessarily drawn to scale.

Referring to FIGS. 1 to 9, the present invention comprises a system 5 with one or more hearing protection devices (HPD) 10. The HPD 10 may take any number of forms, including that of a pair of headphones. The HPD 10 may also incorporate one or both of passive and active noise reduction techniques.

Figure 6:
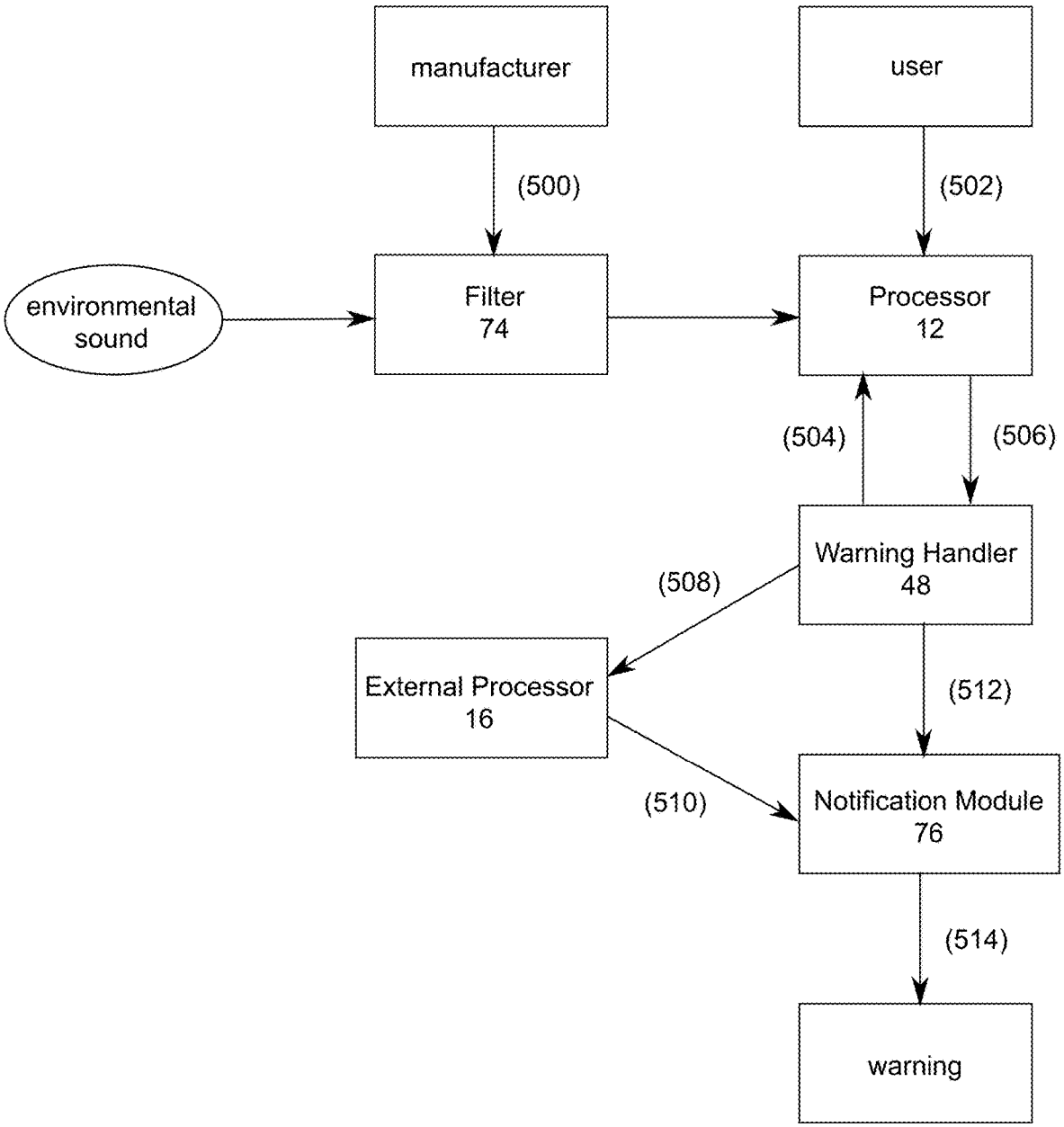
FIG. 6 shows a process flow for the detection of warning sounds in accordance with one embodiment of the invention.

In addition, the HPD 10 comprises a processor 12 that is configured to identify certain predetermined warning sounds (e.g. sirens, horns, backup alerts, designated spoken phrases, etc.). The HPD 10 comprises one or more arrays of acoustic signal to electric signal converters, such as microphones 14 (of FIG. 2), for detecting and capturing sound external to the HPD 10. The microphones 14 are configured to convert the detected sound into electrical representations of the sound. These electrical representations are then sent to the processor 12 for processing (e.g. as shown in the flowchart of FIG. 6) in order to identify if the predetermined warning sounds are present in the detected sound. The electrical representations may also be sent to an external processor 16 that is external to the HPD 10 for processing. This may be done through a wired or wireless connection between the HPD 10 and the external processor 16.

Figure 2:
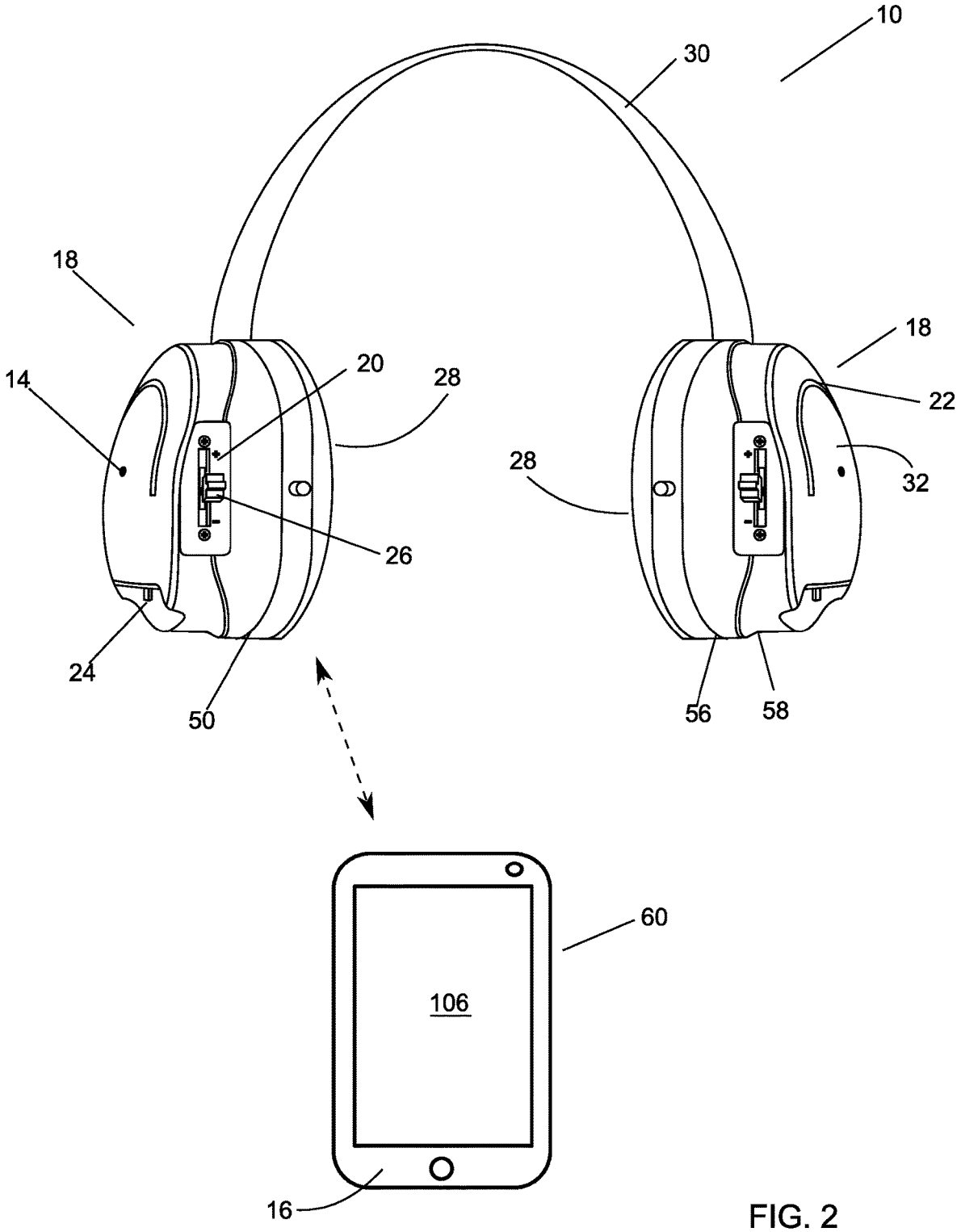
FIG. 2 shows one embodiment of the hearing protection device of the present invention.

Referring to FIG. 2, in one embodiment, the HPD 10 may take the physical form of a conventional earmuff. In this embodiment, the HPD 10 comprises two earpads 18, with each earpad 18 placed on or over an ear of the user. In the embodiment shown, a band 30 may extend between the two earpads 18 and is adapted to fit about the head of the user and to hold the earpads 18 in place over the ears. The HPD 10 may also comprise one or more manual inputs 20 for controlling or adjusting input to the HPD 10. For example, the manual inputs 20 may include a switch 24 to turn on or turn off operation of the HPD 10. The manual inputs 20 may also include a variable input 26, such as a slider or leveler, that allows the user to adjust the degree of sensitivity or volume of the HPD 10. The variable input 26 may be used to adjust the degree of hearing protection for the user. In one embodiment, one or both of the manual inputs 20 and the variable inputs 26 may be located on one or both of the earpads 18. One or more of the microphones 14 may be located on one or both of the earpads 18.

The HPD 10 may also comprise a notification area 22. The notification area 22 may include lights that illuminate to provide visual information. In another embodiment, the notification area 22 may also include a display screen. In the embodiment shown in FIG. 2, the manual inputs 20 and the notification area 22 are located on an exterior surface 32 of one or both of the earpads 18 such that they can be accessed or viewed externally.

One or more of the microphones 14 may be situated at various locations on the HPD 10. The microphones 14 are preferably situated on an exterior surface 32 to allow for better sound detection, such as, for example, on the exterior surface 32 proximate to or on the earpads 18.

The HPD 10 may also comprise one or more speakers 28. In some embodiments, the speakers 28 are embedded within each of the two earpads 18, with any sound generated by the speakers 28 being directed towards the ear of the user. The HPD 10 may also comprise one or more vibration generators 50 that are configured to generate vibratory or haptic feedback to the user. The vibration generators 50 may be located on one or both of the earpads 18 such that any vibratory or haptic feedback may be felt by the user.

In addition, the HPD 10 may comprise one or more ports 38 located on one or both of the earpads 18. The ports 38 may include a Universal Serial Bus (USB) port 40 that may be used for transferring data between the HPD 10 and another external device. Furthermore, the HPD 10 may comprise a battery 42 for supplying electrical power to the various components of the HPD 10. The ports 38, including the USB port 40 may be used to charge the battery 42 from an external power source.

Figure 3:
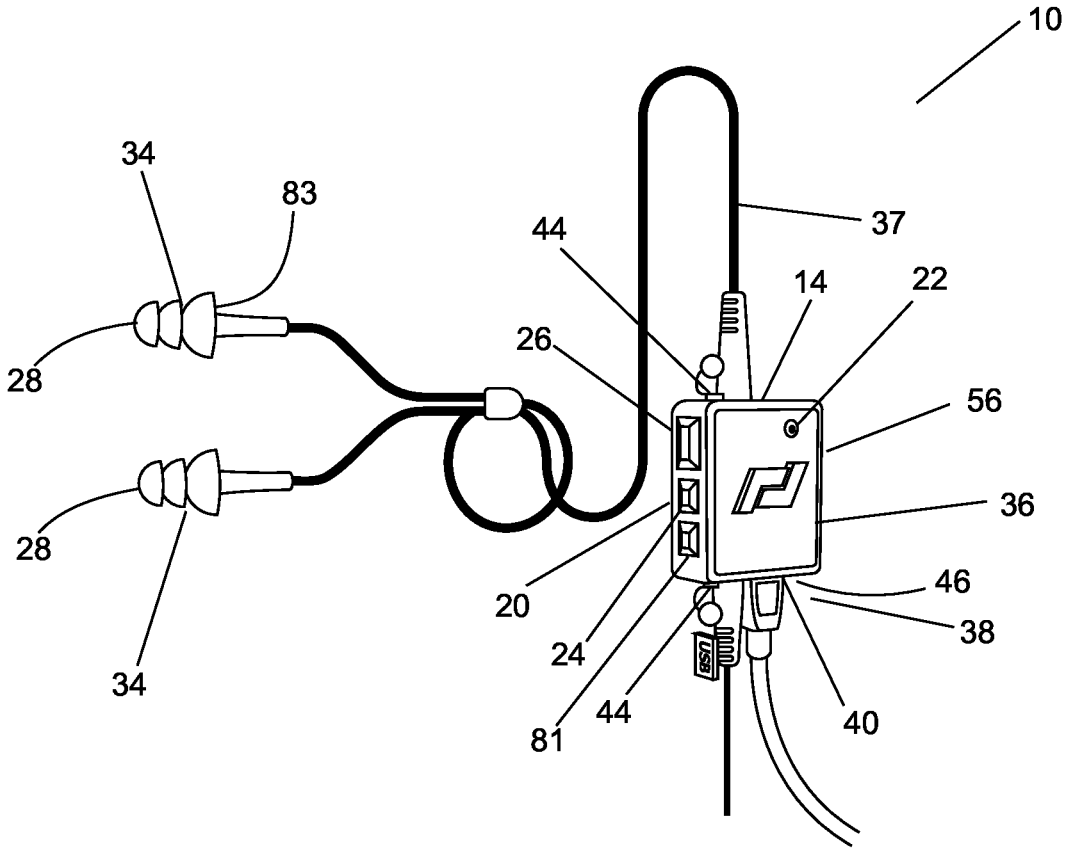
FIG. 3 shows another embodiment of the hearing protection device of the present invention.

Referring to FIG. 3, in another embodiment, the HPD 10 may take the physical form of conventional earphones. In this embodiment, the HPD 10 comprise two earbuds 34, with the earbuds 34 being electrically connected to a control unit 36 through wire 37. In embodiments, the earbuds 34 may have a high noise rejection rating. The control unit 36 may comprise one or more of the manual inputs 20 (i.e. the switch 24 and the variable input 26). The control unit 36 may also comprise the notification area 22 to provide visual information. The manual inputs 20 may be configured to perform various tasks when activated. In addition, the manual inputs 20 may be configured to perform various tasks when activated in a particular sequence (e.g. when activated twice in quick succession).

In the embodiment shown, one or more of the microphones 14 may be situated on the control unit 36. One or more of the speakers 28 may also be embedded within one or both of the earbuds 34 such that any sound generated by the speakers 28 may be directed to the ear of the user. In one embodiment, one or more of the microphones 14 may also be located on one or both of the earbuds 34.

The control unit 36 may also comprise one or more of the ports 38 for interfacing the HPD 10 with other devices. For example, the ports 38 may include the Universal Serial Bus (USB) port 40 for transferring data between the control unit 36 and an external device. The control unit 36 may comprise the battery 42 within the control unit 36 for supplying electrical power to the various components of the HPD 10, in which case the USB port 40 may also be used to charge the battery 42 using an external power source. The ports 38 may also include an input port 44 for receiving data from other radio devices and may also include an output port 46 that provides a connection for the wire 37 from the control unit 36 to the earbuds 34 (and allows for the transfer of data between the two).

Detection of warning sounds using the HPD 10 will now be described. The detection of warning sounds may be done using supervised machine learning. In particular, the processor 12 (as shown and discussed with respect to FIGS. 6 and 7) may be trained using supervised machine learning techniques. In one embodiment, prerecorded audio samples labeled as being appropriate warning signals are inputted to the processor 12, and through the training process, the free parameters of the detection system will be adjusted by the processor 12. The learning can be transferred dynamically by the user in situ to the processor 12. For example, upon the presence of a new improved warning detection engine, the new values for the free/tunable parameters can be transferred to the processor 12, and the detection engine on the processor 12 can be updated.

The user can also invoke the learning system on the processor 12 when a new warning signal is playing and the processor 12 can extract the signatures of the new warning signal and detect it automatically afterwards.

Moreover, the warning detection system of the processor 12 can also be trained through unsupervised machine learning techniques. For this, a large number of different types of warning sounds are continuously introduced to the processor 12 and over time, the processor 12 is able to distinguish and identify similar warning sounds. In one embodiment, clustering algorithms may be used, such as K-mean clustering to the N-dimensional scattered plot data with each feature on its own axis. The data with similar features can will be clustered together (unsupervised grouping). The cluster information will be used as a method to categorize different warning signals. These unsupervised learning techniques can also be done on the external processor 16, which can then transmit the warning signatures of different types to the processor 12. In embodiments, the external processor 12 is included in a mobile device or remote server communicatively coupled to HPD 10. The grouping/clustering information can then be transferred to the device itself for the future appropriate grouping of the new incoming warning signals.

Moreover, in one embodiment, machine learning techniques or other detecting algorithms may be used to detect characteristics of a particular sound. For example, machine learning techniques may be used to detect the characteristics of a conventional siren. The processor 12 can then remove those characteristics in the frequency domain from a streaming signal. In other words, the processor 12 may be configured to scan the signals (sounds) received from the microphones 14 and if the characteristics of the siren are detected, the processor 12 may be configured to remove those characteristics from signals. In this manner, users (such as fire fighters) can continue to stream signals from the microphones 14 and have those signals played through the speakers 28 except for the sound of the siren. This would allow the user to hear other sounds that may be masked by the siren (which can be very loud).

The HPD 10 can also be configured to detect different type of external sounds and based on their characteristics, interrupt an acoustic stream being provided to a user by turning off the acoustic stream to allow the user to hear the surrounding sounds and/or provide a warning sound. For example, in some embodiments, the HPD 10 detects bicycle rings and based on the speed of approaching and proximity (extracted from the growth rate of the amplitude of the bicycle ring sound), may generate different levels of warning to the user. For example, if the user is listening to music at the time, the HPD 10 may turn off the music and stream the surrounding sounds (e.g. the bicycle rings) to the user. That way, if there is a bicycle rider sounding the bicycle rings, and there is a user in front listening to the music, the HPD 10 can be configured to allow the user to hear the sound of the bicycle ring. Alternatively, the HPD 10 may be configured to turn off the user's music if the HPD 10 recognizes (or detects) the sound of a moving bicycle chain coming closer and closer to the user. Depending of the speed of the bicycle approaching, the user may receive different notifications (e.g. a fast and loud "Beep Beep" sound, a vocal message, a low-frequency "Beep Beep" sound, etc.). The HPD 10 may also vibrate and illuminate to notify the user. Alternatively, the HPD 10 may cause an audible message (such as "Watch out!", "Bike!", or "Bike coming!" in English or different languages to be played in order to notify the user. In another application it can detect any speech and turn off the music and turn on the surrounding sounds.

In addition, the HPD 10 may be configured to not only detect bicycle rings to determine if a bicycle is approaching but may detect other sounds that may be associated with an approaching bicycle. For example, the HPD 10 may be configured to detect the sound the chain of the bicycle makes when moving. The HPD 10 may be configured to determine, based on the sound made by the chain, whether the bicycle is moving towards or away from the user. Furthermore, the HPD 10 may be configured to detect words that may be spoken by individuals on the bicycle or nearby. For example, the HPD 10 may be configured to detect if someone says "Watch out!", "Bike!", "Bike coming!", or the like, in English or different languages.

The HPD 10 comprises a warning handler 48 that is triggered when a warning sound (e.g. a siren, a bicycle ring, etc.) is detected. The warning handler 48 may be a separate unit from the processor 12, or alternatively, it may be integrated with the processor 12. Thus, in embodiments, warning handler 48 includes a separate hardware circuitry unit from the processor 12, software run on or residing in processor 12 or combination thereof. In the event that the processor 12 detects one or more of the warning sounds, the processor 12 may trigger the warning handler 48 in order to send a notification to the user. The notification may take the form of a vibratory signal (i.e. haptic feedback), an auditory signal (e.g. played to the speaker 28), or a visual signal (e.g. the illumination of lights or the display of a text message through the notification area 22), or in the form of electromagnetic signals (e.g. radio, cellular, Wi-Fi, Bluetooth signals, etc.) to an external handheld device that the user or others are using. For example, in one embodiment, the detection of one or more of the warning sounds by the processor 12 may result in the processor 12 triggering the warning handler 48 to cause one or more of the vibration generators 50 to trigger, creating a vibration in the HPD 10 that may be felt by the user. The HPD 10 may be configured to provide vibrations at different locations on the HPD 10, depending on the location of the vibration generators 50 on the HPD 10. In addition, the vibrations may be customizable in terms of intensity and/or pattern of vibration.

In one embodiment, the HPD 10 may comprise a notification module 76 that is configured to accept notifications from the warning handler 48 and effects notification to the user. The notification module 76 is preferably connected to one or more of the components responsible for alerting the user, such as the speakers 28, the notification area 22, etc. The notification module 76 may be a separate unit from the processor 12 and/or the warning handler 48. Alternatively, the notification module 76 may be integrated with one or both of the processor 12 and the warning handler 48.

Furthermore, in one embodiment, the HPD 10 may also comprise a transceiver 52 connected to the notification module 76 and is configured to transmit the notification wirelessly to other nearby users that are also wearing a similar one of the HPD 10 (e.g. 10*a*) or to a central gateway 54, that is part of the system 5. The central gateway 54 may be a computer that is configured to receive and/or relay notifications. These wireless communications may be carried out using Wi-Fi, cellular, Bluetooth, or the like.

In addition to being triggered by the detection of a predetermined warning sound, the notification may also be triggered by other means, including:

(a) The receipt of a message and/or signal from an external software application (e.g. an app installed on a mobile device), an emergency broadcasting system, other ones of the HPD 10, or other external devices (such as a wristband, as described later). In one embodiment, one of the HPD 10 may act as a "broadcaster" of messages and/or signals to other ones of the HPD 10. For example, if one of the HPD 10 receives a message and/or signal, that particular one of the HPD 10 may broadcast or transmit (using the transceiver 52) the same message and/or signal to other ones of the HPD 10, acting as a repeater so the other ones of the HPD 10 is able to receive the message and/or signal. This transmission can happen in a peer-to-peer mode to ensure the other ones of the HPD 10 receives (using the transceiver 52) the message and/or signal even if they are not in the range to receive the original message and/or signal. In this embodiment, the other ones of the HPD 10 may have cause to have a notification triggered, which would then be handled by the notification module 76 as described above.

(b) The detection by the HPD 10 of certain words in one or more languages (e.g. "Watch out!" or the like).

(c) The receipt a text message or a phone call (e.g. such as through the app). In this embodiment, the HPD 10 may be configured to accept a notification from an external mobile device (such as a cellular phone) that a text message or a phone call has been received. The notification module 76 may be triggered to provide notification to the user of the text message or the phone call.

In another embodiment, the HPD 10 may also comprise one or more motion sensors 56. The motion sensors 56 are configured to record and transmit data to the processor 12 regarding the movement of the HPD 10. If the processor 12 determines, based on the data received from the motion sensors 56, that the HPD 10 is falling, the processor 12 may determine that the user (who is wearing the HPD 10) is likely falling and may also trigger the warning handler 48. Alternatively, if the processor 12 determines, based on the data received from the motion sensors 56, that the HPD 10 has not moved for a certain period of time, the processor 12 may also trigger the warning handler 48 (as this may be an indication that the user may be in distress and unable to move). In either scenario, the warning handler 48 may cause a notification to be generated to the notification module 76. The notification 76 may cause the user to be alerted (e.g. through the vibration generators 50, the notification area 22, the speakers 28, etc.). In addition, the notification module 76 may cause the transceiver 52 to generate a message and/or signal to the central gateway 54 or to other ones of the HPD 10. Furthermore, the processor 12 may cause the transceiver 52 to transmit a telephone call, an email, or some other alert to others. In this manner, the HPD 10 may be configured to generate an alert (acoustic or electromagnetic).

In another embodiment, the system 5 may comprise one or more proximity sensors 58 to record and transmit data to the processor 12 regarding changes in distance between the proximity sensors 58 and other objects. The proximity sensors 58 may include optical proximity sensors, capacitive proximity sensors, ultrasonic proximity sensors, or other types of suitable proximity sensors. In embodiments, the information may in turn cause the warning handler 48 to generate an appropriate notification. The warning handler 48 may be hardware or software based. For example, if a truck is moving towards the HPD 10, the proximity sensors 58 would be able to detect the changes in distance between the truck and the HPD 10. If the processor 12 determines, based on the data received from the proximity sensors 58, that an object is approaching the user, the processor 12 may be configured to trigger the warning handler 48. This determination by the processor 12 depends, at least in part, on the rate that the object is approaching the user, the estimated size of the object, and the direction from which the object is approaching the user. This information may be provided to the processor 12 by the proximity sensors 58. The processor 12 may also take into account or other information, such as any conventional backup alert or siren sounds detected by the microphones 14. Using the information from the proximity sensors 58 and/or the microphones 14, the processor 12 may also be configured to determine the nature of approaching object (e.g. if the processor determines that the backup alert corresponds to conventional backup alerts used by trucks) and cause the warning handler 48 to generate the appropriate notification accordingly. This technique can be in particular important since it can detect in all directions from the HPD 10 and therefore can detect objects that are approaching the HPD 10 from the blind sides of the user, thereby improving the awareness of the user.

Figure 5:
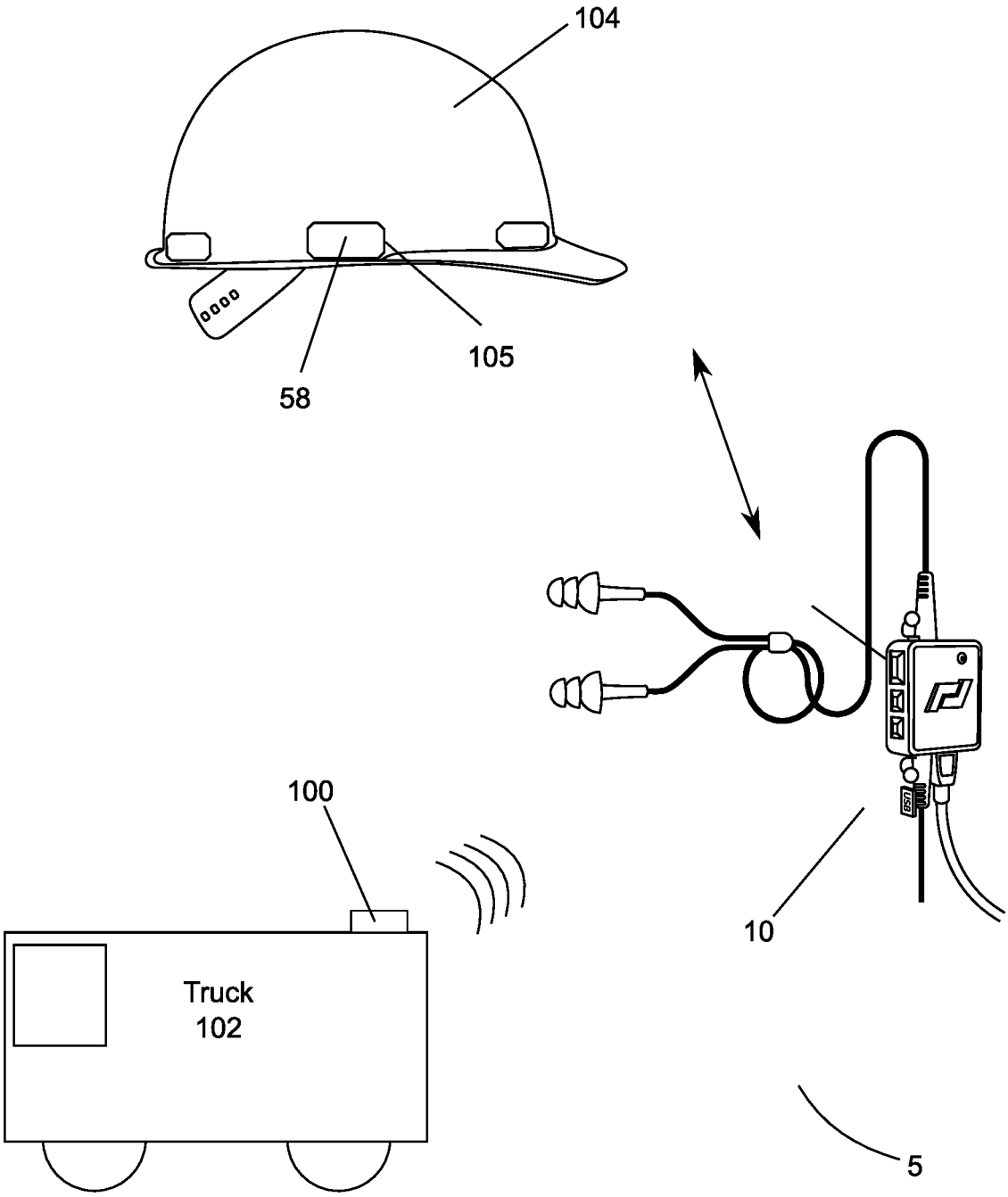
FIG. 5 shows another embodiment of the system, comprising an article.

In yet another implementation, referring to FIG. 5, the system 5 further comprises one or more radio frequency (RF) broadcaster 100 that may be provided and installed in series with, e.g., a conventional backup alert system of trucks 102 or other vehicles with backup alert. The RF broadcaster 100 is configured to transmit a designated pattern of data (such as status of the vehicle, geographical location of the vehicle, etc.) with a designated RF power only when the truck 102 or vehicle is backing up, and when the backup alert is activated. The transceiver 52 on the HPD 10 may be configured to periodically scan for such RF signals and, based on the designated pattern, the processor 12 may be configured to recognize it as a backup alert and based on the received RF power, to determine the approximate distance of the truck 102 (or vehicle) that is backing up. For example, if the processor 12 determines that the signal from the RF broadcaster 100 is getting stronger, the processor 12 may determine that the truck 102 is getting closer (physically) (also observable from mapped real time distance) to the HPD 10, and thus the user. This may result in the warning handler 48 being triggered by the processor 12. Alternatively, if the processor 12 determines that the signal is getting weaker, the processor 12 may determine that the truck 102 is moving farther away. This is in particular useful if there are multiple ones of the trucks 102 present, with more than one backup alert operating at the same time. In these circumstances, it may not be possible to rely solely on acoustic detection, as it losses its accuracy.

In another embodiment, the system 5 may also comprise one or more articles 104 that may be worn by the user. The articles 104 may include, but are not limited to, hard hats, vests, wristbands, etc. A plurality of article microphones 105 may be placed on the articles 104. The data received by the article microphones 105 may be transmitted to the HPD 10 for further processing. For example, the article microphones 105 may transmit data to the HPD 10 using Bluetooth. Alternatively, the article microphones 105 may transmit data between themselves using Bluetooth, before the data is transmitted by one of the article microphones 105 to the HPD 10. The data from the article microphones 105 may be used by the processor 12 to determine the direction of oncoming objects by triangulating data from the plurality of article microphones 105.

The motion sensors 56 and the proximity sensors 58 are preferably located on the HPD 10 (such as on the control unit 36, the earbuds 34, or the earpads 18). For example, where the HPD 10 is in the form of earmuffs, the motion sensors 56 and/or the proximity sensors 58 may be located on or proximate to one or both of the earpads 18. Alternatively, the motion sensors 56 and the proximity sensors 58 may be located externally from the HPD 10 and transmit data (wired or wirelessly) to the processor 12. In another implementation, where the HPD 10 takes the form of earphones, the proximity sensors 58 can be located on the control unit 36.

Referring to FIG. 5, in another embodiment, the proximity sensors 58 may be located external to the HPD 10, such as on articles 104. The proximity sensors 58 are able to transmit data to the HPD 10. In various embodiments, the proximity sensors 58 can also be implemented on clothes and vehicles as well.

Furthermore, the processor 12 may be configured to customize the notification in order to provide the user with some information about the nature of the notification. For example, if the notification is in the form of haptic feedback by the vibration generators 50, the vibration patterns may be different for different types of notifications. In one embodiment, the vibrations may be similar to Morse code. In yet another embodiment, where the notification is an auditory signal (e.g. causing the speakers 28 to generate a beeping sound), the beep sounds may be closer together when the object is getting closer to the HPD 10.

Referring to FIG. 5, the processor 12 is configured to detect external sounds in order to identify particular warning sounds and/or spoken words in noisy environments (as received by the microphones 14) and to provide a notification to the user using the warning handler 48. The processor 12 may trigger the warning handler 48 to send the notification to the user in any combination of cases where the source of the warning sound is approaching or moving away from the HPD 10, the source of the warning sound is detected to be nearer than a predetermined threshold, and/or if the HPD 10 is determined to be not moving away from the source of warning signal.

The general direction of warning sounds can be triangulated by comparing the intensity measured at the different ones of the microphones 14 and/or through using data from other ones of the HPD 10 received by the transceiver 52 via wireless communication.

In another embodiment, the processor 12 may be configured to trigger the warning handler 48 to generate the notification to the user if the processor 12 determines that the warning sound or signal originates from a certain direction with respect to the user. For example, the processor 12 may be configured to trigger the warning handler 48 if the processor 12 determines that the warning sound is coming from the user's blind spots (i.e. beyond the user's normal field of vision). For example, where the HPD 10 is in the form of an earmuff, the processor 12 may be configured to approximate the direction from where the warning sound is coming based on the orientation of the earpads 18 (left versus right) and the location of the microphones 14.

For example, the present invention may be used to detect the presence of a backup alert (i.e. a type of warning sound) generated by the truck 102 that is moving backwards. The microphones 14 located on the HPD 10 are configured to pick up external sounds and convert them into electrical signals for processing by the processor 12. The processor 12 processes the electrical signals and looks for certain electrical signatures (e.g. a signature corresponding to the backup alert) in time and/or frequency domains. These signatures may include (but are not limited to) the frequencies of interest, variance of frequencies of interest, variance of amplitude of frequencies of interest, the duration of the warning sounds, the period of the repeating warning sounds, and physical direction of the warning sounds.

The processor 12 is also configured to be able to detect whether the source of the sounds (e.g. the truck 102) is approaching the HPD 10 (and thus the user) or moving away from the HPD 10 (and thus away from the user). For example, the processor 12 may be configured to only trigger the warning handler 48 if the truck 102 is approaching the HPD 10. This can be determined by the processor 12 using methods including, but not limited to, analyzing the associated Doppler effect. The processor 12 may also be further configured to provide the warning handler 48 with information regarding the direction of movement of the object and/or the source of the warning sound (e.g. the backup alert). The warning handler 48 is able to provide the notification module 76 with the information in an understandable form. For example, the notification module 76 may cause the speakers 28 to output, "Truck approaching from behind" or "Backup Alert Detected!".

Such vocal playback need not be stored on the HPD 10. In one embodiment, the system 5 may also comprise a mobile device 60. For example, the external processor 16 may be located on the mobile device 60. The processor 12 may be configured to detect the warning sound, triggering the warning handler 48 and causing the notification module 76 to transmit a warning signal to the mobile device 60 through the transceiver 52. The mobile device 60 may include a smartphone, a tablet, or the like that is configured by an application 106. The warning signal may, for example, be in the form of a serialized data structure containing the different parameters that specify the exact nature of the warning signal. For example, one field of the data structure might enumerate the type of warning signal (e.g. backup truck versus fire siren), while another field of the data structure might contain the direction that the sound is coming from. A third example field of the data structure may contain information on whether the source of the sound is physically approaching the user.

Once the mobile device 60 receives the data structure, the application 106 can take the appropriate action in response to the data structure. For example, the mobile device 60 may be configured by the application 106 to generate an appropriate voice warning via a text-to-speech mechanism, open a voice stream channel to the HPD 10 (through the transceiver 52) and stream the vocal warning to the HPD 10 for playback through the speakers 28. Additionally, the mobile device 60 may also cause other forms of feedback to the user, such as vibrations. The vibrations may be in a certain pattern, depending on the nature of the warning signal.

The mobile device 60 can also be used (through the application 106) to adjust the settings for the HPD 10, such as configuring an identifier (e.g. name) for the HPD 10 and changing the sensitivity of the HPD 10 (e.g. configuring the approximate distance of the warning sound at which the processor 12 will trigger the warning handler 48). The mobile device 60 can also identify the user through the name and media access control (MAC) address of the mobile device 60 and using the location of mobile device 60 (such as through Global Positioning System), estimate the location of the user.

This, in particular, may be used in case of emergencies to determine whether certain users are still located in particular areas, depending on the locations of users as determined by the HPD 10 and the mobile devices 60.

In another embodiment, the HPD 10 may be configured to provide a streaming functionality. For example, the microphones 14 on the HPD 10 may be configured to detect and record the surrounding sounds, and the processor 12 can be further configured to play, in real-time, the detected and recorded audio sounds through the speakers 28 after applying denoising and warning detection algorithms on them. In this manner, the user can listen to the surrounding environment without hearing certain noises, increasing awareness of his or her surroundings.

The processor 12 is able to detect the main frequencies of noise that is considered unwanted and reject them (during streaming) by the use of a number of filters 74. In one embodiment, the number of filters 74 of FIG. 6 may be from 1 to 7. The filters 74 are a combination of one or more of low-pass, high-pass, notch, and/or band-pass filters. The characteristics (such as type, quality factor, or bandwidth) and frequency of each filter 74 may be adjusted by the user or noise cancellation system versus time. The filters 74 are able to dynamically track the main frequencies of noise considered unwanted and attenuate them. For example, the processor 12 may be previously provided with certain patterns or frequencies of noises that are considered to be unwanted or undesirable.

The processor 12 may be configured to reject common unwanted noise by subtracting the sounds collected by different ones of the microphones 14 from each other with designated gains. This would allow the processor 12 to pick the sounds of sources located in a particular direction (e.g. the front of the HPD 10) while subtracting the sounds that are coming from other sources in other directions.

In yet another embodiment, the processor 12 may be configured to reject or attenuate background noise by obtaining the frequency spectrum of the background noise and subtracting that from the stream of the incoming sound. In this manner, the detection of speech and warning sounds will be improved while background noise will be attenuated. One method to achieve noise profile is window averaging the incoming sound in frequency or time domains or weighted combination of time and frequency domains. By adjusting the window size, the processor 12 may be configured to pick up certain noises in the background. This noise profile may later on subtracted from the incoming spectrum of sounds.

In another embodiment, the HPD 10 may be configured to provide adjustable acoustic protection. For example, the processor 12 may be configured to provide different levels of acoustic protection depending on the volume and duration of exposure of the external noise. The processor 12 may adjust the protection to the best suited Noise Reduction Rating (NRR). The processor 12 may also measure the power (or equivalently, sound pressure level) of the external noise and determine whether the user is required to put on the HPD 10.

Noise cancellation and rejection can be done in combination of methods in both time and frequency domains. In one method, the noise rejection can be done by subtracting the noise spectrum from the incoming signals spectrum and therefore improve the vocal spectrum. It can also be done in time domain by rejecting loud and high intensity signals and attenuating the signal to a safe level in a fast method (dynamic compression). In yet another method, noise rejection can be done by the use of combination of different ones of the microphones 14 and subtracting their signals in different (or the same) weight in a way that the signal that carries more vocal sound has higher weight and get subtracted by microphone output signal which has the same or less amount of background noise and/or vocal sound. This method may be referred to as "multiple mic noise cancellation".

In yet another embodiment, the sounds from two or more of the microphones 14 may be subtracted through a beamforming algorithm (e.g. adding a dynamic delay to one or more microphone signals prior to subtractions), so that only certain directions receive high signal gain while some directions reject all incoming sounds. This can be improved by dynamically adopting the weight and polarity of the subtraction from two or more of the microphones 14 and in that way generates dynamically programmable "null" angles where sounds from these angles are more attenuated. This can be in particular useful when the user wants to cancel sounds from loud factory instruments that are approaching to user from certain angles. This may be referred to as "noise cancellation with dynamic beam forming".

In another embodiment, the HPD 10 may identify sirens from firetrucks by extracting the frequency and characteristics of the siren. The processor 12 may be configured to use these characteristics and to remove the siren sound in time or frequency domain using one or combination of noise cancellation methods and algorithms. In this manner, a firefighter that is using the HPD 10 may be able to hear his or her surroundings and the street sounds without hearing the sirens from nearby firetrucks. In one implementation the processor 12 may be configured to find the characteristics of the siren (through machine learning or preloaded data given by the manufacturer) and based on that, remove the component of the siren from frequency or time domain component of the incoming sound. After removal, the sound with attenuated siren sound can be played by the speakers 28 to allow the user to be more aware of his or her surroundings.

In another embodiment, the processor 12 may be configured to measure the volume of the external noise detected by the microphones 14, to measure the duration of its exposure to the user, to measure the time that the user has been exposed to the external noise, and to determine the weighted noise power (in dBA) from the noise profile, and based on a combination of this information, make a determination as to the appropriate level of Noise Protection Rating (NPR). This determination may be made, at least in part, based on recommended standards set by governmental or safety authorities. Based on this determination, the processor 12 may be configured to adjust the level of noise protection for the HPD 10.

The processor 12 may be configured to check that the sound outputted to the user through the speakers 28 remains below a certain threshold (e.g. 85 dB). If a sudden loud noise is detected by the processor 12, the processor 12 may be configured to reduce the amplification gain (the gain on converting the acoustic signal to a digital signal) as soon as possible to ensure that the user will always receive sound at a consistent volume level through the speakers 28.

Figure 4:
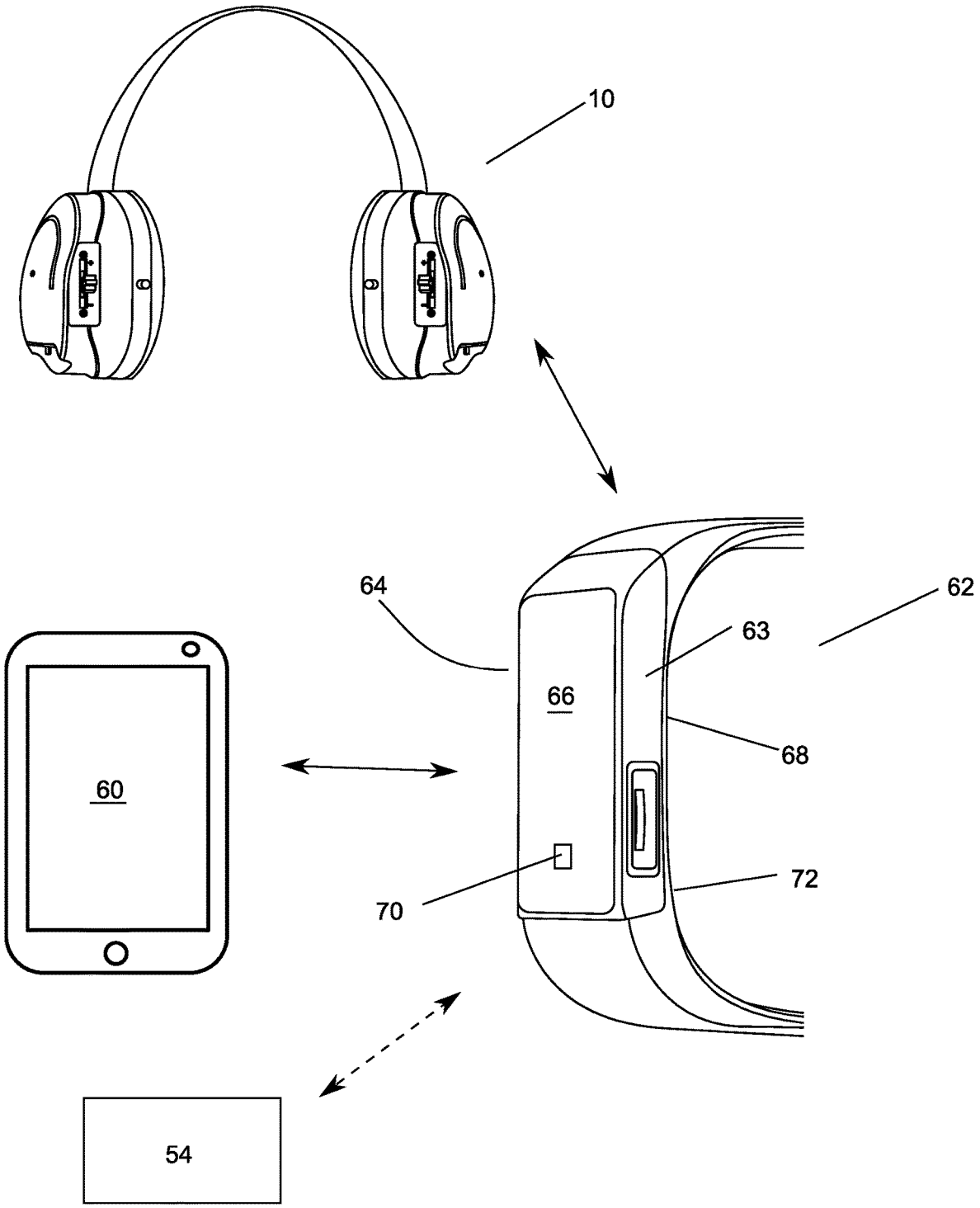
FIG. 4 shows another embodiment of the system, comprising a wristband.

Referring to FIG. 4, the system 5 may also comprise a wristband 62 that is in wireless communications with the HPD 10 through a wristband transceiver 64 located on the wristband 62. The wristband 62 may be worn on the wrist of the user and comprises a wristband interface 66. The wristband interface 66 may comprise a touchscreen (e.g. with a graphical user interface), a button, or the like. The wristband 62 can act as both a mechanism for input to one or more of the HPD 10 and/or one or more of other ones of the wristbands 62 at the same time. The wristband 62 comprises a wristband processor 63 for controlling and receiving input from various components on the wristband 62.

In one embodiment, the wristband processor 63 may be configured to allow the wristband 62 to communicate with the HPD 10 that the user is wearing as well as another one of the HPD 10 that another user is wearing. The wristband 62 can also be paired with the mobile device 60 that the user is carrying, or it may also be paired and communicate with the central gateway 54. As an example, the user may tap on the wristband interface 66 in order to issue commands to the wristband 62. If the user wishes to communicate with another user through the HPD 10, the user may tap on the wristband interface 66. In one example, different commands may be assigned to different tap patterns. For example, communicating with user A may involve tapping on the wristband interface 66 once, while communicating with user B may involve tapping on the wristband interface 66 twice. Similarly, communicating with all users simultaneously may involve tapping on the wristband interface 66 six times. The particular tap patterns may be configured by the user.

In one embodiment, the wristband 62 may be paired with the HPD 10 using RSSI values of the connection protocol (e.g. BLE) used to communicate between the wristband 62 and the HPD 10. For example, the user may use the wristband interface 66 to enter into "pairing mode" and then bring the wristband 62 physically closer to the HPD 10 (e.g. within 10 centimeters) or alternatively, in physical contact with the HPD 10. When the wristband 62 is physically closer to the HPD 10 (or in physical contact with the HPD 10), the HPD 10 will detect a high RSSI value from the wristband 62, which the processor 12 may interpret as an indication that the wristband 62 is to be paired with the HPD 10.

The wristband 62 may also comprise wristband sensors 68, which may include one or more of accelerometers, gyroscopes, motion sensors, GPS, heat sensors, infrared proximity sensors and/or heart rate sensors that provide input to the wristband processor 63. For example, the wristband sensors 68 are able to detect if the wristband 62 has not moved for a certain period of time or if the user is not vertical. Upon receipt of this information by the wristband processor 63, the wristband processor 63 may be configured to cause the information to be transmitted by the wristband transceiver 64 to the central gateway 54 or the HPD 10 for further processing. The wristband 62 may comprise wristband vibration generators 72 for providing haptic feedback to the user, upon receipt of appropriate commands from the wristband processor 63.

The wristband 62 may also comprise wristband microphones 70 for recording sounds and sending the data to the wristband processor 63 for further analysis (e.g. to determine if they correspond to warning sounds). Alternatively, the wristband processor 63 may be configured to simply cause the data to be transmitted to the HPD 10 using the wristband transceiver 64 for processing and determination by the HPD 10 of whether a warning sound is present.

The input signals that are generated by the wristband 62 may not be purely active signals. The user need not interact or "do something" with the wristband 62 in order to generate an input signal. The lack of interaction or a change in a signal pattern may be enough to trigger an action. As an example, if the wristband sensors 68 detect a stoppage or pause in movement, or some other measurable change, the wristband processor 63 may cause a notification to be generated. For example, if the user has fallen asleep, the wristband sensors 68 may detect that the pattern of motion (based on gyroscopes and accelerometers) has changed and that the heart rate (based on the heart rate sensors) has changed. From this information, the wristband processor 63 may be configured to make a determination as to whether the user may have fallen asleep. The wristband processor 63 may cause a signal to be transmitted to the HPD 10 that triggers a haptic feedback on the HPD 10 along with some other notification (e.g. to the mobile device 60 or the central gateway 54).

In one embodiment, the wristband processor 63 may have full signal detection embedded in its own hardware so that when it detects a warning sound, it notifies the user using a visual indicator, such as a flashing light, an icon on the wristband interface 66 or through vibration (e.g. using the wristband vibration generators 72) or haptic or taptic feedback. The wristband 62 can update itself through mobile that is connected to the Internet. It can also have BLE and/or Wi-Fi connectivity.

The HPD 10 may be wirelessly connected to the mobile device 60. For example, two users C, D may each be wearing respective ones of the HPD 10 (HPD 10*c*, 10*d*), with each carrying one of the mobile devices 60 (mobile devices 60*c*, 60*d*) wirelessly connected to their respective HPD 10 (HPD 10*c*, 10*d*, respectively). The mobile devices 60*c*, 60*d* may be connected to the HPD 10*c*, 10*d*, respectively by wireless communications, such as Bluetooth, Wi-Fi, or cellular connections. In this manner, users C, D may communicate with each other through their respective HPD 10*c*, 10*d* over virtually unlimited distances (limited only by the range of the connections between the respective mobile devices 60*c*, 60*d*). Once user C has connected the mobile device 60*c* to the HPD 10*c*, user C will be able to view, on the mobile device 60*c*, a list of other users that user C can connect to. If user C chooses to connect with user D (using, for example, a push-to-talk button), a corresponding notification will be sent to the mobile device 60*d* of user D. Once the connection has been established, voice communications may be made between users C, D through the speakers 28*c*, 28*d* and microphones 14*c*, 14*d* located on the respective HPD 10*c*, 10*d*. In addition, it is also possible for user C to connect with a number of other users in order to communicate with them.

In another embodiment, the HPD 10 may use Bluetooth low energy (BLE) to communicate with each other, with the communications being encrypted. For example, if user C wishes to connect to user D, both users C, D simply need to turn on their respective HPD 10 (HPD 10*c*, 10*d*). The HPDs 10 are able to automatically connect to each other, and either user C or user D can start the conversation by pressing an appropriate button (e.g. a push-to-talk button) on the HPD 10. If user C wishes to connect to multiple other users (that are in range), all of the users simply need to turn on their respective HPDs 10. The HPDs 10 are able to automatically connect to each other. In one embodiment, the particular HPD 10 on which the user initiated the conversation first (e.g. the first user to press the push-to-talk button) will be designated as the speaker, and all of the other HPDs 10 will be designated as receivers and can only listen to communications from the particular HPD 10. This may be modified by one of the other users pressing on the push-to-talk button on his or her one of the HPDs 10 in a predetermined manner (e.g. pressing three times in a row). At that time, that HPD 10 will now be designated as the speaker, with the other HPDs 10 being designated as receivers.

In another embodiment, the microphones 14 on the HPD 10 may also be used to detect tap sounds made by the user on the HPD 10. The processor 12 may be configured to identify such tap sounds and carry out commands based on those tap sounds. For example, a particular tap pattern may be used to initiate a call with another predetermined user.

Referring to FIG. 6, which shows a process flow in accordance with an embodiment of the invention, the filters 74 may be preconfigured (500) by the manufacturer so that the processor 12 detects certain warning sounds from the general environmental sounds picked up by the microphones 14 and potential proximity and movement sensors. In addition, the processor 12 may also be configured in situ (502), such as by transferred by user and/or through machine learning. In other words, through machine learning, the processor 12 may be trained to detect further warning sounds that have not been preconfigured. The level of sensitivity for detecting warning sounds may also be adjusted (504) by the user. In the event that a warning sound is detected (506) by the processor 12, the warning handler 48 is triggered.

In yet another embodiment, the warning sounds may be recorded by the HPD 10, and the recorded data can be streamed to a mobile or a central processing unit and from there they can be transmitted through the Internet and/or Internet-of-Things to a cloud and/or a central server for further development and training of the signal detection. Part of or the entire of the signal processing algorithm may be upgraded based on recorded feedback data, and the new codes can be rewritten automatically as an update to any of the HPD 10 that are connected to a mobile companion application and from there connected to the Internet.

In one embodiment, the HPD 10 can detect a pattern of sounds and perform an action related to a warning related to the sounds. These patterns of sounds can be three whistles or a particular phrase like "Man Down" and the action can be to call the pre-set emergency contact or 911 or calling or paging the lead of operation. It can also be to turn on the lights associated with the HPD 10 (e.g. the notification area 22) and make them flash with different colors to be able to easily spot the victim or user in need. This can be in particular useful for incapacitated user in need.

In one embodiment, the warning handler 48 may transmit (508) a message to the external processor 16, with the message containing information regarding the detected warning sounds. The external processor 16 may be located on another device external to the HPD 10, such as the mobile device 60. The external processor 16 may carry on additional processing on the detected warning sounds. The external processor 16 may have access to information and data not available to the processor 16 (such as location information, etc.). This information or data may affect whether the presence of the warning sound should be alerted to the user. For example, if the external processor 16 has access to location information about the user and the external processor 16 determines that the user is in an area that does not need to be subject to warning sound detection, the external processor 16 may override detection of the warning sound and not alert the user Based on the external processor 16 processing of the warning sound, the external processor 16 may (or may not) cause (510) the notification module 76 to be triggered.

Alternatively, in the event that the external processor 16 is not involved, the warning handler 48 may directly trigger (512) the notification module 76. The notification module 76 may then cause (514) the notification to be provided to the user (e.g. through auditory signal, vibratory feedback, etc.).

The external processor 16 (or the application 106) may be used to perform real-time or ahead of time noise cancellation processes using variation of noise cancellation and speech enhancement algorithm if the processor 12 of the HPD 10 is not sufficient or is in power saving mode. The external processor 16 may also be used to process coding or decoding the data if the processor 12 of the HPD 10 is not sufficient or is in power saving mode.

Figure 7:
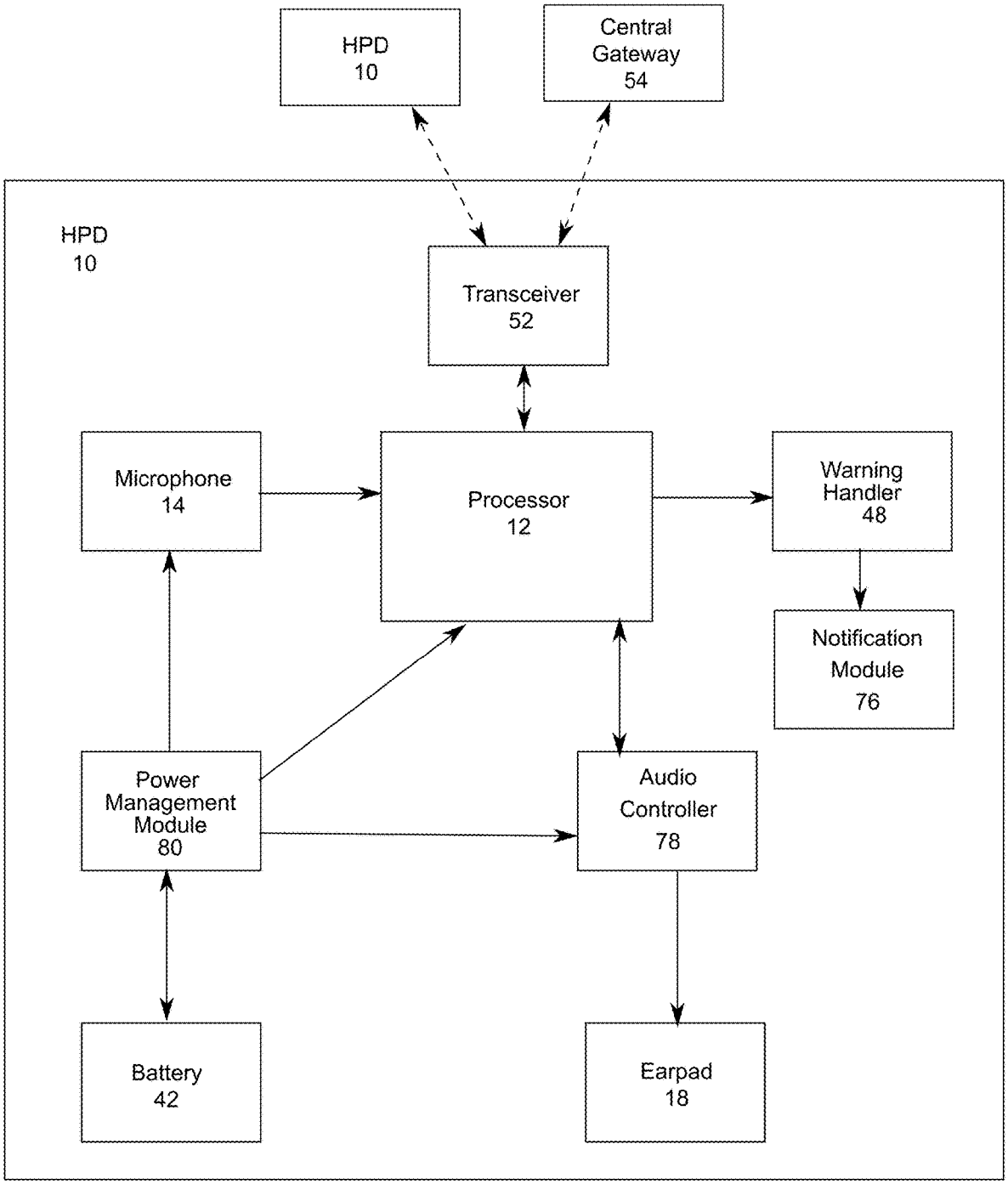
FIG. 7 shows a block diagram of the components in accordance with one embodiment of the invention.

Referring to FIG. 7, which shows a block diagram of some of the components of the HPD 10, the processor 12 receives input from the microphones 14 in the form of electrical signals (converted from audio signals). The electrical signals are processed by the processor 12. In the event that a warning sound is detected, the processor 12 may send a notification to the warning handler 48, which in turn may (as discussed above) send a notification to the notification module 76 for communication to the user (e.g. by auditory signals, vibratory feedback, etc.).

In the event of detecting a potential alert, the processor 12 might not send any signal to the warning handler 48, if the detected warning sound is too far, or in the line of sight of the user (can realize through directions using proximity sensors 58 (of FIG. 5) or array of the microphones 14) or if the user already moved away or if the user disabled the system 5 from notifying him/her from such type of the warnings.

In addition, the processor 12 may also communicate with an audio controller 78 to adjust and/or control the volume and/or content of the auditory output transmitted to the earpad 18 or the earbud 34.

The battery 42 may provide power to the HPD 10. The battery 42 may be rechargeable. The HPD 10 may also comprise a power management module 80, including software, hardware, or combination thereof, for controlling power provided to the microphones 14, the processor 12, and/or the audio controller 78.

In another embodiment, voice may be captured by the HPD 10, and noise cancellation and coding can be applied to it by the processor 12 or the mobile device 60. The resultant data may be sent to the central gateway 54 that other users are also connected to. If the users are set to 'listen" to a particular channel or user, the users would be able to hear the sound from anybody that is registered to those channels or the particular user. This may be referred to as voice communication as URPTT ("Unlimited Range Push To Talk"). URPTT can be a two-way or one-way channel. URPTT may use Internet, Wi-Fi, Internet of Things, or Bluetooth to connect to all users.

In yet another implementation, the voice communication can be transferred between two or more of the HPD 10 without the use of the mobile device 60. This may be referred to as SRPTT (for "Short Range Push To Talk"). Voice will be recorded by each of the HPD 10, after potential noise cancellation and coding algorithms are applied. The resultant data will be sent to one or more recipients that are set by the mobile or through pairing process, through BLE, WIFI, or Bluetooth. Recipients can engage in a conversation by pushing a Push-To-Talk ("PTT") button 81 provided on the HPD 10.

In embodiments, to start either the URPTT and SRPTT process, the PTT button 81 may be pressed and held by the user. While the user is holding the PTT button 81 (pressed), the user can talk and his or her conversation will be recorded and transmitted to the other users (through their HPDs 10). In yet another implementation, the user may push the PTT button 81 twice (or thrice) in rapid succession and start the conversation. In some embodiments, the user does not need to hold down the PTT button 81 to start the conversation. This method can be referred as hands-free PTT. In some embodiments, to stop the conversation, the user may press the PTT button 81 one time. Both SRPTT and URPTT may enable communication between HPDs 10 that are "registered" with the same organization. That means that if a person found one of the HPD 10 and is part of the same organization, that person cannot tap over the conversation.

In various embodiments, to make the SRPTT and URPTT processes secure, each of the HPD 10 has to be first registered. The registration process can be conducted by connecting to another one of the HPD 10 (e.g. using BLE connectivity). In embodiments, the user should create a password for each of the HPD 10 or security can be enabled by face ID, biometric, or other identifying technology. The user preferably needs to enter the password to connect the HPD 10 to the application 106 to set up and initialize the URPTT and SRPTT communication groups. During registration, the processor 12 may be configured to send some unique characteristics of the HPD 10 to the registering device (which may be the mobile device 60) and it can be later sent to a central server 7 to record and use as identification criteria for the HPD 10. These unique criteria may include one or more of the device IMEL, serial number, firmware revision, code name, and any secret code that is registered in the HPD 10 or any combination of those. In embodiments, when the user connects to the HPD 10 using the password, the end user app would compare that with what is recorded on the server 7 and if correct, it would allow the user to configure and listen to URPTT and SRPTT groups.

In embodiments, the SRPTT process will always connect to any nearby users wearing other ones of the HPD 10. In addition, the HPD 10 may continue to refresh to search for the new ones of the HPD 10 in range. It is possible to customize (e.g. using the application 106) the range in which the SRPTT process is used to connect nearby ones of the HPD.

The SRPTT process can use different mechanisms to estimate the proximity of other users. Such method can be through using Bluetooth, Wi-Fi, or other signal strength power, where lower signal strength can represent users in farther distances. For example, the processor 12 may be provided information regarding signal strength from external sources (e.g., a signal strength meter IC) or using a Received Signal Strength indicator (RSSI) index within the HPD 10. The SRPTT process can also use other mechanisms to estimate the distance between users, such as the proximity sensors 58 located on the HPD 10.

In some embodiments, the SRPTT process may only connect to a limited number of users. The SRPTT process may use a group identification tag and/or estimated users' distances as two factors to choose which limited users would be selected to be connected. For example, the SRPTT process may connect the HPD 10 to the nearest five users that share the same particular group identification tag. The group identification tag may be set during registration.

To ensure that the SRPTT and URPTT processes and streaming have substantially maximum quality of sound, the processor 12 can execute a programmable coder and decoder algorithm that adjusts the data compression of the raw signals. When the number of connected users increases or the users are located in farther distances (i.e. more lossy channel), the processor 12 may be configured to increase the compression ratio, and when number of users decreases or the distances are shortened, the processor 12 may be configured to use lower compression ratio and higher sound quality.

The mobile device 60 may remember the password, and if the HPD 10 corresponds to the mobile device 60 (using the same unique criteria of each HPD 10 hardware), the mobile device 60 will not ask for the password, at least for a particular period of time.

In various embodiments, during registration of each of the HPD 10, the application 106 may automatically generate a software tag to devices in the same group of employees or affiliated users to identify them from each other. This tag maybe advertised by the HPD 10 after SRPTT and URPTT activation (by the user after entering the password) and the user can listen and connect by SRPTT to other users that carrying the similar tag or tags. This is useful to ensure that the SRPTT process is only working for same organization's employees or for particular groups inside a company (e.g. fueling crew).

The application 106 may allow the user to select from a number of voice channels that the user can choose to listen to. When the user selects one or more channels, the user would be notified about an incoming conversation if the user is not wearing the HPD 10 or if the HPD 10 is disconnected from mobile device 60. This notification can be in the form of an alarm and/or a written notification message to the mobile device 60.

In some embodiments, if the user is wearing the HPD 10 and chooses to listen to one or multiple channels/groups, when an incoming conversation arrives in any of these channels, the user can hear them. If the user chooses to reply, the user can press the PTT button 81, and the application 106 will automatically send the user's response (vocal) to the last channel from which the user received conversation.

The application 106 can transfer the geographical information of the user to the server 7 using an onboard GPS (global positioning Systems) on the HPD 10 or by GPS or A-GPS on the mobile device 60. This data can be used to determine, for example, if some users are still on site when the site is to be evacuated. The data may also be used for localizing uses, annotating users that are not moving and may be injured, or identifying the location of users with specific conditions (e.g. coronavirus, etc.).

In one embodiment, the HPD 10 may be configured to detect when other users with other ones of the HPD 10 are located within a certain distance. That can be done either using GPS system above or RSSI RF power levels that can be measured by the HPD 10. If the measured RSSI values are higher than some threshold that indicates that the other ones of the HPD 10 are closer than certain threshold. This may be useful for social distancing purposes. For example, the HPD 10 may be configured to provide an alert to the user if the HPD 10 detects that another one of the HPD 10 is within two meters.

On top of the SRPTT and URPTT processes, the ports 38 may include a sound port (e.g. 32 mm jack or other audio input/output ports) that connects to the conventional one-way or two-way radios. The user may change the setting to send the voice by pressing the PTT button 81 from the HPD 10, and the processor 12 may apply denoising algorithm before transferring sounds to the radio systems.

In case of receiving sound from conventional radio systems, the processor 12 may apply one or more denoising algorithms to receiving sounds before playing it on earmuff or earplug speakers. In addition, the processor 12 may automatically detect the incoming radio voice from external radio devices and subsequently automatically play that to the users' ears.

The processor 12 in the HPD 10 or the external processor 16 can detect other users' sneezing and coughing sounds and in combination with data coming from temperature sensors 83 embedded on the earpads 18 or the earbuds 34 or other parts of the user, detect whether the user might be infected with influenza or any other virus. This data may be transferred to the central gateway 54 or the server 7 for further processing and for monitoring the spread of the virus.

The user may reach customer support through the application 106. By adding the information about the nature of support required, the application 106 is able to transmit the user's request to a helpdesk, and a member of support team can assist the user.

Figure 8:
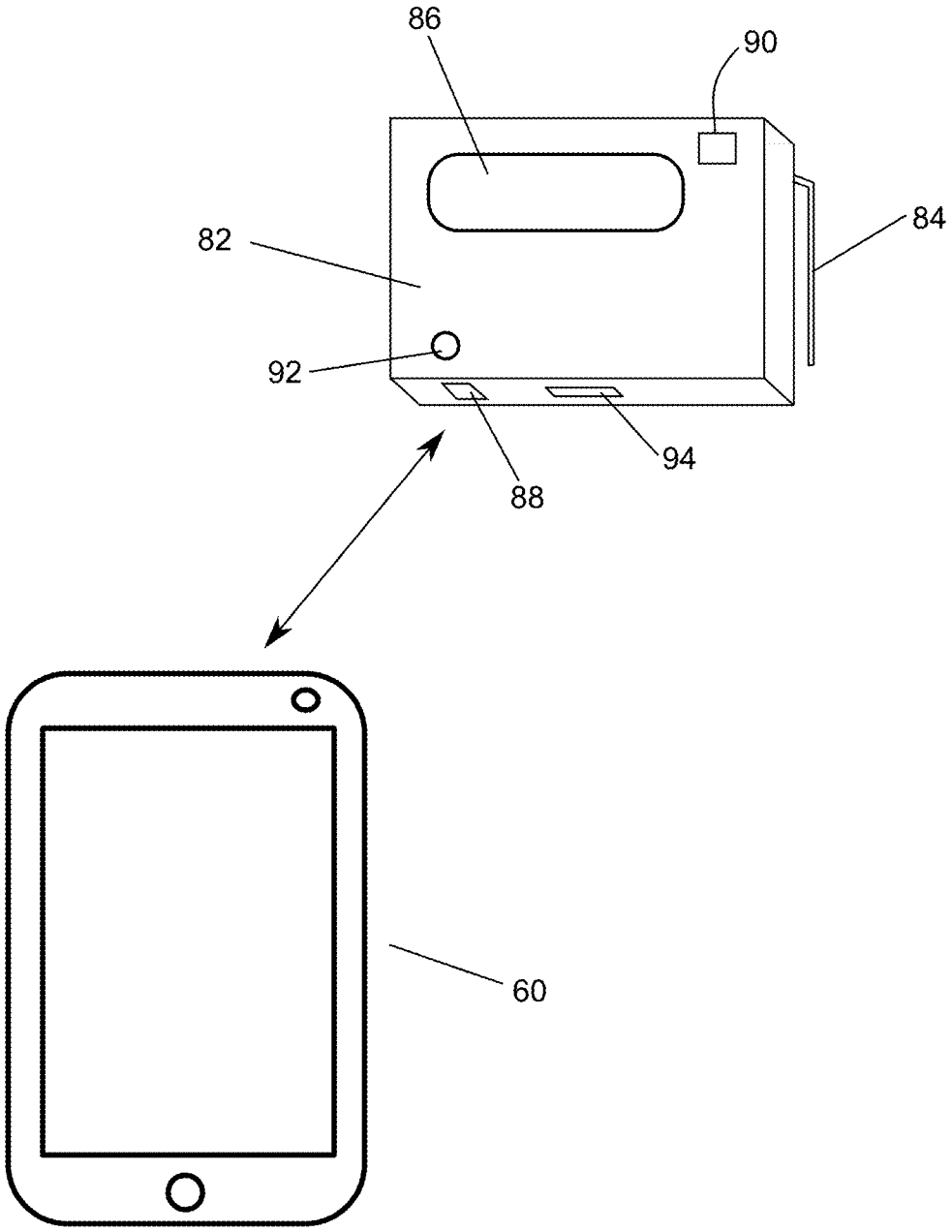
FIG. 8 shows another embodiment of the system, comprising a tag.

In another embodiment, referring to FIG. 8, a tag 82 may be provided. The tag 82 preferably comprises a clip 84 that is adapted to removably attach the tab 82 to the user's clothing. For example, the clip 84 may comprise adhesive material for attaching the tag 82 to the clothing, or the clip 84 may have some mechanical mechanisms for attachment to the clothing. The tag 82 comprises a tag display 86 for displaying information to the user and a tag transceiver 88 for wireless communications. The tag transceiver 88 may communicate with mobile device 60 carried by the user. In such an embodiment, the mobile device 60 may have installed upon it a mobile application to coordinate communications between the mobile device 60 and the tag 82. The wireless communications may be done through Bluetooth, Wi-Fi, or the like.

The tag 82 comprises a tag processor 90 and one or more tag microphones 92. The tag microphones 92 are configured to detect and capture sound external to the tag 82 and to convert them into electrical representations for processing by the tag processor 90. Using techniques described earlier, the tag processor 90 is configured to detect if the electrical representations captured by the tag microphones 92 correspond to specific predetermined sounds. For example, if the electrical representations correspond to a human voice saying "behind", the tag processor 90 may be configured to cause an alert to be raised. This could indicate a possible cyclist or person behind and approaching the user. The specific predetermined sounds may include other words (e.g. "stop", "watch out", etc.) or other non-verbal sounds (e.g. a bicycle bell, a siren, etc.).

The alert may cause tag vibrators 94 on the tag 82 to activate, causing vibrations that may be felt by the user. Alternatively, the alert may be transmitted by the tag transceiver 88 to the mobile device 60. This may cause the mobile device 60 to, for example, pause the playback of music or other audio so that the user can now hear external sounds more clearly.

The tag display 86 may display information to the user regarding the alert. In addition, the tag display 86 may be configured to display other information when the alert is not in effect. For example, the tag display 86 may be configured to display the title or artist for music currently playing on the mobile device 60.

Figure 9:
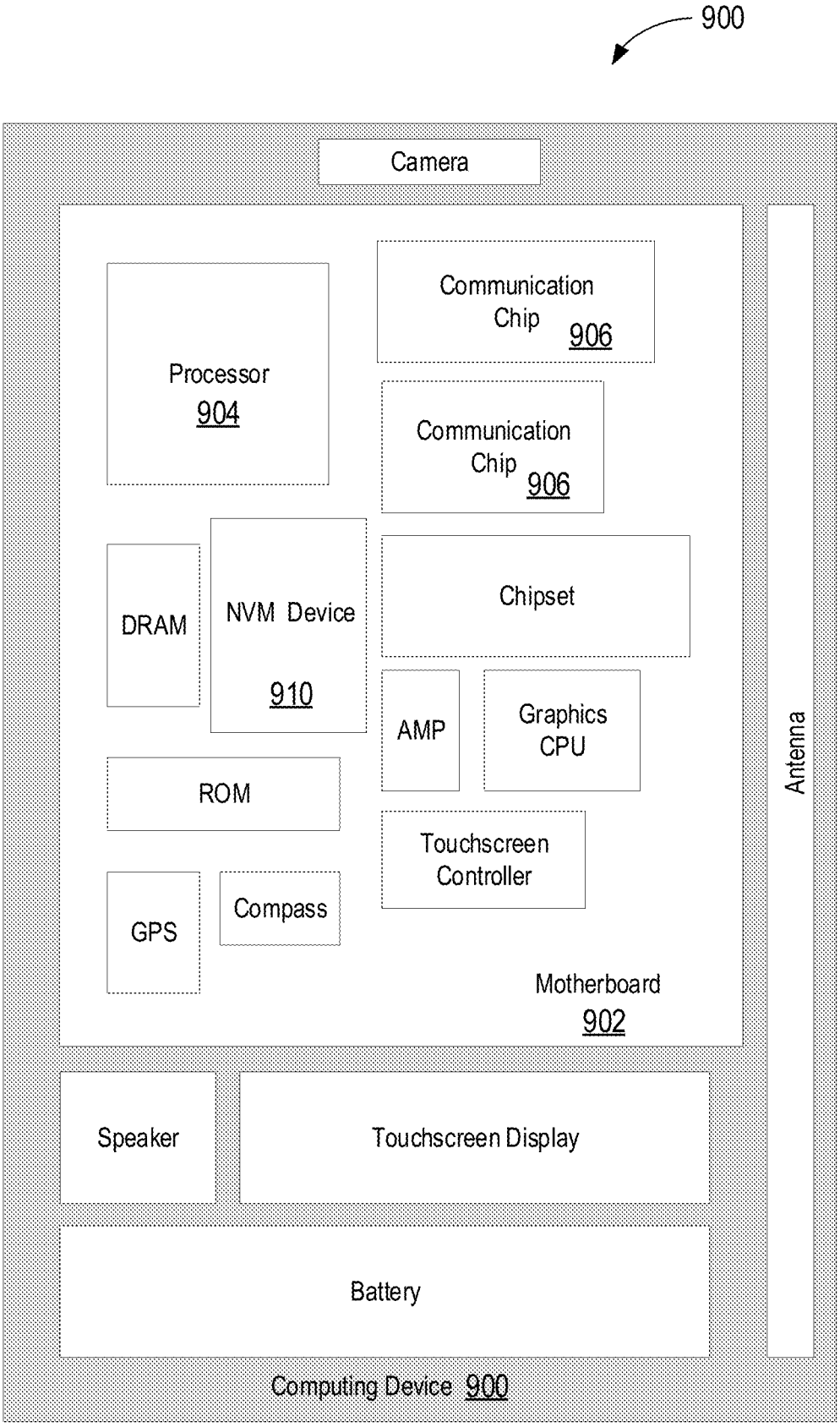
FIG. 9 illustrates a computing system that may be used to implement various aspects of the embodiment.

FIG. 9 illustrates a computing system including a computing device 900 that may be used to implement various aspects of the embodiments of the present disclosure. In some embodiments, computing device 900 or components of computing device 900 includes, e.g., mobile phone 60 of FIGS. 1, 2, 4, and 8 or remote computer or a server (e.g., that includes server 7 of FIG. 1) communicatively couples to mobile phone 60 and/or HPD 10.

In embodiments, computing device 900 houses a board 902, such as, for example, a motherboard. The board 902 may include a number of components, including but not limited to a processor 904 and at least one communication chip 906. The processor 904 is physically and electrically coupled to the board 902. In some implementations, the at least one communication chip 906 is also physically and electrically coupled to the board 902. In further implementations, the communication chip 906 is part of the processor 904.

Depending on its applications, computing device 900 may include other components that may or may not be physically and electrically coupled to the board 902. These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

The communication chip 906 may enable wireless communications for the transfer of data to and from the computing device 900, including, e.g., between computing device 900 and HPD 10 of FIGS. 1-4. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 906 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing device 900 may include a plurality of communication chips 906. For instance, a first communication chip 906 may be dedicated to shorter range wireless communications such as Wi-Fi and Bluetooth and a second communication chip 906 may be dedicated to longer range wireless communications such as GPS, EDGE, GPRS, CDMA, WiMAX, LTE, Ev-DO, and others.

The processor 904 of the computing device 900 includes an integrated circuit die packaged within the processor 904. The term "processor" may refer to any device or portion of a device that processes electronic data from registers and/or memory to transform that electronic data into other electronic data that may be stored in registers and/or memory.

In various implementations, the computing device 900 may be a laptop, a netbook, a notebook, an ultrabook, a smartphone, a tablet, a personal digital assistant (PDA), an ultra mobile PC, a mobile phone (e.g., mobile phone 60 of FIGS. 1, 2, 4, and 8)), a desktop computer, a server such as the server 7 in FIG. 1 (e.g., a data center server or high-performance server). In further implementations, the computing device 900 may be any other electronic device that processes data.

In the foregoing description, exemplary modes for carrying out the invention in terms of examples have been described. However, the scope of the claims should not be limited by those examples but should be given the broadest interpretation consistent with the description as a whole. The specification and drawings are, accordingly, to be regarded in an illustrative rather than a restrictive sense.

The invention claimed is:

1. A safety apparatus for a user, the apparatus comprising:

a hearing protection device to be worn over the ears of the user; and a communications device to be carried by the user, the communications device to be in communication with the hearing protection device, wherein the communications device comprises:

one or more microphones for converting acoustic signals into electrical signals;

a processing unit adapted to receive the electrical signals from the one or more microphones, wherein the processing unit is further adapted to generate a warning to the hearing protection device based, at least in part, on information from the electrical signals; and a transceiver for communicating with another one of the communications device;

wherein the communications device is adapted to determine, based on the power of signals received from the another communications device, an approximate distance to the other one of the communications device and to transmit the warning when the approximate distance is less than a predetermined distance.

2. The safety apparatus of claim 1, wherein the communications device is adapted to transmit the warning to another one of the communications device through the transceiver.

3. The safety apparatus of claim 1, wherein the processing unit is further adapted to compare first parameters of the electrical signals from the microphones with second parameters of predetermined warning sounds to determine whether the electrical signals comprise one or more of the predetermined warning sounds, and wherein if the processing unit determines that the electrical signals comprise one or more of the predetermined warning sounds, the processing unit is adapted to generate the warning.

4. The safety apparatus of claim 1, wherein the communications device is a wristband.

5. The safety apparatus of claim 1, wherein the communications device comprises a user interface, wherein the user interface is adapted to accept haptic input from the user.

6. A safety apparatus for a user, the apparatus comprising:

a hearing protection device to be worn over the ears of the user; and a communications device to be carried by the user, the communications device configured to be in communication with the hearing protection device, wherein the communications device comprises:

one or more microphones for converting acoustic signals into electrical signals;

a processing unit adapted to receive the electrical signals from the microphone, wherein the processing unit is further adapted to generate a warning to the hearing protection device based, at least in part, on the information from the electrical signals; and a transceiver for communicating with another one of the communications device;

wherein the communications device is adapted to determine, based on the power of signals received from the another communications device, an approximate distance to the other one of the communications device and to transmit the warning when the approximate distance is less than a predetermined distance.

* * * * *